US011834957B2

(12) United States Patent
Hirata et al.

(10) Patent No.: US 11,834,957 B2
(45) Date of Patent: Dec. 5, 2023

(54) STRUT COVER, EXHAUST CASING, AND GAS TURBINE

(71) Applicant: MITSUBISHI HEAVY INDUSTRIES, LTD., Tokyo (JP)

(72) Inventors: Tomoyuki Hirata, Yokohama (JP); Eiichi Tsutsumi, Yokohama (JP); Kazuki Kitagawa, Yokohama (JP); Takayoshi Iijima, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/634,052

(22) PCT Filed: Sep. 9, 2020

(86) PCT No.: PCT/JP2020/034097
§ 371 (c)(1),
(2) Date: Feb. 9, 2022

(87) PCT Pub. No.: WO2021/049523
PCT Pub. Date: Mar. 18, 2021

(65) Prior Publication Data

US 2022/0325635 A1 Oct. 13, 2022

(30) Foreign Application Priority Data

Sep. 12, 2019 (JP) ..... 2019-165806

(51) Int. Cl.
*F01D 25/26* (2006.01)
*F01D 25/28* (2006.01)
*F01D 25/30* (2006.01)

(52) U.S. Cl.
CPC ..... *F01D 25/26* (2013.01); *F01D 25/28* (2013.01); *F01D 25/30* (2013.01); *F05D 2220/32* (2013.01)

(58) Field of Classification Search
CPC ..... F01D 25/26; F01D 25/28; F01D 25/30; F01D 9/041; F01D 9/065
See application file for complete search history.

(56) References Cited

U.S. PATENT DOCUMENTS 5,292,227 A * 3/1994 Czachor ..... F01D 9/065 415/142
5,335,490 A * 8/1994 Johnson ..... F23R 3/20 60/764

(Continued)

FOREIGN PATENT DOCUMENTS

DE 11 2018 003 131 3/2020
JP 2004-346885 12/2004

(Continued)

OTHER PUBLICATIONS

Notice of Reasons for Refusal for Japanese Patent Application No. 2019-165806 dated Aug. 8, 2023, English translation (Year: 2023).*

(Continued)

*Primary Examiner* — Topaz L. Elliott
(74) *Attorney, Agent, or Firm* — Wenderoth, Lind & Ponack, L.L.P.

(57) ABSTRACT

A strut cover for a gas turbine includes: a cylindrical sheet metal member having a hollow portion; and a flare member that is connected to one end of the cylindrical sheet metal member in an axial direction of the cylindrical sheet metal member and includes a curved portion having an outer surface such that a distance from a center axis of the cylindrical sheet metal member to the outer surface increases with increasing a distance from the cylindrical sheet metal member in the axial direction. The flare member has a thickness larger than a minimum thickness of the cylindrical sheet metal member at least in the curved portion.

10 Claims, 10 Drawing Sheets

(56) References Cited

U.S. PATENT DOCUMENTS

| | | | | |
|---|---|---|---|---|
| 5,609,467 | A * | 3/1997 | Lenhart | F01D 25/162 415/142 |
| 8,152,451 | B2 | 4/2012 | Manteiga et al. | |
| 9,644,494 | B2 | 5/2017 | Hashimoto | |
| 2010/0061846 | A1* | 3/2010 | Herbst | F01D 5/005 29/888.021 |
| 2010/0135786 | A1* | 6/2010 | Manteiga | F01D 25/18 415/232 |
| 2014/0205447 | A1* | 7/2014 | Patat | F01D 25/125 415/111 |
| 2015/0040393 | A1* | 2/2015 | Shteyman | B23P 15/00 29/888.02 |
| 2015/0044046 | A1 | 2/2015 | Shteyman et al. | |
| 2015/0260057 | A1 | 9/2015 | Farah et al. | |
| 2015/0337687 | A1* | 11/2015 | Scott | F01D 25/10 415/215.1 |
| 2016/0017807 | A1* | 1/2016 | Chuong | F01D 25/30 415/213.1 |
| 2016/0123166 | A1* | 5/2016 | Ols | F01D 9/041 415/210.1 |
| 2017/0159465 | A1* | 6/2017 | Schlemmer | F01D 5/16 |
| 2017/0241291 | A1* | 8/2017 | Boeck | F01D 25/28 |
| 2018/0187551 | A1* | 7/2018 | Buchholz | F01D 5/14 |
| 2019/0063259 | A1* | 2/2019 | Garner | F01D 25/12 |
| 2020/0141281 | A1 | 5/2020 | Ikeguchi et al. | |
| 2021/0231021 | A1* | 7/2021 | Maurya | F01D 25/24 |

FOREIGN PATENT DOCUMENTS

| | | | |
|---|---|---|---|
| JP | 2010025006 | A * | 2/2010 |
| JP | 2010-127276 | | 6/2010 |
| JP | 2013-057302 | | 3/2013 |
| JP | 2019-002376 | | 1/2019 |

OTHER PUBLICATIONS

International Search Report dated Nov. 17, 2020 in International Application No. PCT/JP2020/034097 with English translation.

Translation of the International Preliminary Report on Patentability dated Mar. 24, 2022 in International Application No. PCT/JP2020/034097.

* cited by examiner

STRUT COVER, EXHAUST CASING, AND GAS TURBINE

TECHNICAL FIELD

The present disclosure relates to a strut cover for a gas turbine, an exhaust casing including the strut cover, and a gas turbine.

BACKGROUND

The gas turbine is equipped with a combustor for generating high-temperature and high-pressure combustion gas using compressed air and fuel, a turbine rotationally driven by the combustion gas to generate rotational power, and an exhaust casing to which the combustion gas that has rotationally driven the turbine is supplied (see Patent Document 1, for example). The combustion gas that has rotationally driven the turbine is converted to static pressure in the diffuser passage of the exhaust casing. The diffuser passage is defined by a cylindrical outer diffuser and a cylindrical inner diffuser disposed inside the outer diffuser.

In Patent Document 1, a strut is connected to a casing wall forming the outer shape of the exhaust casing and to a bearing casing internally accommodating a bearing portion that supports the rotor. The casing wall is disposed outside the outer diffuser, and the bearing casing is disposed inside the inner diffuser. Accordingly, the strut is arranged so as to traverse the diffuser passage.

In Patent Document 1, a strut cover covers the strut and forms a flow passage for cooling air between the strut cover and the strut. The strut cover is connected at the outer end to the outer diffuser and at the inner end to the inner diffuser. The outer end and the inner end of the strut cover have a flare shape with a large bulge in the outer shape. Further, the components of the exhaust casing such as the strut cover are manufactured by sheet metal welding.

CITATION LIST

Patent Literature

Patent Document 1: JP2013-57302A

SUMMARY

Problems to be Solved

The outer diffuser and the inner diffuser vibrate when the combustion gas flows through the diffuser passage, and stress (vibration stress) is generated by the vibration in the strut cover connecting the outer diffuser and the inner diffuser. Further, stress (impact stress) is generated by the impingement of the combustion gas on the strut cover.

In recent years, as the output power of the gas turbine has increased, the temperature of the combustion gas flowing through the diffuser passage tends to increase. The outer diffuser, the inner diffuser, and the strut cover may become hot due to the heat transferred from the combustion gas. In such a high temperature environment, the risk of break or damage to the strut cover increases due to high cycle fatigue caused by the stress generated in the strut cover.

Since the strut cover described in Patent Document 1 has a uniform thickness from the outer end to the inner end, the stress is concentrated on the flare portion, and the strut cover may break or be damaged due to high cycle fatigue caused by the stress.

In view of the above, an object of at least one embodiment of the present disclosure is to provide a strut cover for a gas turbine that can improve the high cycle fatigue strength.

Solution to the Problems

A strut cover for a gas turbine according to the present disclosure comprises: a cylindrical sheet metal member having a hollow portion; and a flare member that is connected to one end of the cylindrical sheet metal member in an axial direction of the cylindrical sheet metal member and includes a curved portion having an outer surface such that a distance from a center axis of the cylindrical sheet metal member to the outer surface increases with increasing a distance from the cylindrical sheet metal member in the axial direction. The flare member has a thickness larger than a minimum thickness of the cylindrical sheet metal member at least in the curved portion.

An exhaust casing of a gas turbine according to the present disclosure comprises: a cylindrical casing wall; a cylindrical outer diffuser disposed on a radially inner side of the casing wall; an inner diffuser disposed on a radially inner side of the outer diffuser and forming a diffuser passage between the inner diffuser and the outer diffuser; and the above-described strut cover. The flare member of the strut cover includes: an outer flare member connected to the outer diffuser; and an inner flare member connected to the inner diffuser.

A gas turbine according to the present disclosure comprises the above-described exhaust casing.

Advantageous Effects

At least one embodiment of the present disclosure provides a strut cover for a gas turbine that can improve the high cycle fatigue strength.

DETAILED DESCRIPTION

Figure 1:
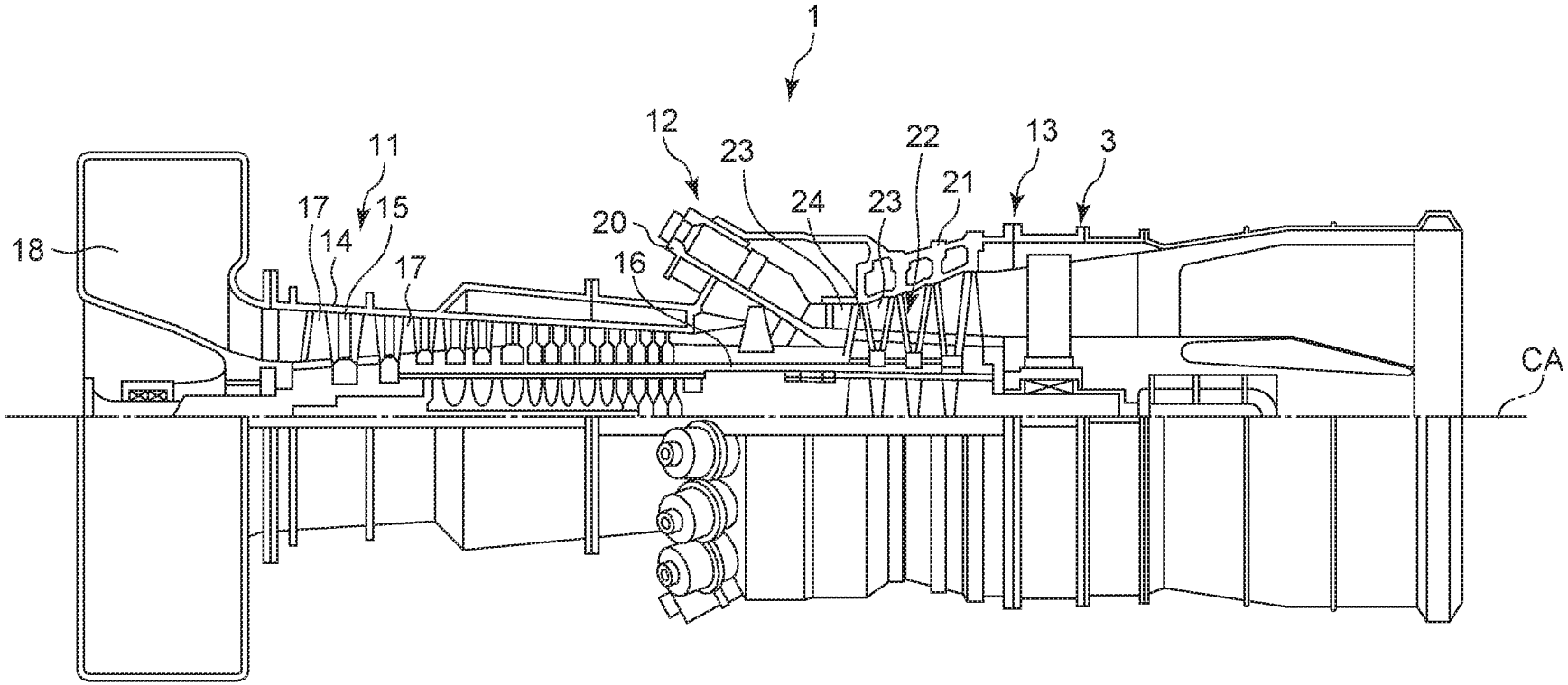
FIG. 1 is a schematic configuration diagram of a gas turbine according to an embodiment.

Embodiments of the present disclosure will be described below with reference to the accompanying drawings. It is intended, however, that unless particularly identified, dimensions, materials, shapes, relative positions, and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

The same features can be indicated by the same reference numerals and not described in detail.

(Gas Turbine)

FIG. 1 is a schematic configuration diagram of a gas turbine according to an embodiment.

As shown in FIG. 1, a gas turbine 1 according to some embodiments includes a compressor 11 for producing compressed air, a combustor 12 for producing combustion gas using the compressed air and fuel, a turbine 13 configured to be driven by the combustion gas to rotate, and an exhaust casing 3 to which the combustion gas that has rotationally driven the turbine 13 is supplied. In the case of the gas turbine 1 for power generation, a generator (not shown) is connected to the turbine 13.

The compressor 11 includes a plurality of stator blades 15 fixed to a compressor casing 14 and a plurality of rotor blades 17 implanted on a rotor 16 so as to be arranged alternately with the stator blades 15.

To the compressor 11, air sucked in from an air inlet 18 is supplied. The air supplied to the compressor 11 flows through the plurality of stator blades 15 and the plurality of rotor blades 17 and is compressed into compressed air having a high temperature and a high pressure.

The combustor 12 is supplied with fuel and the compressed air produced in the compressor 11. The combustor 12 combusts the fuel to produce combustion gas that serves as a working fluid of the turbine 13. In the embodiment shown in FIG. 1, the gas turbine 1 has a plurality of combustors 12 arranged along the circumferential direction around the rotor 16 inside a casing 20.

The turbine 13 has a combustion gas passage 22 formed by a turbine casing 21 and includes a plurality of stator blades 23 and a plurality of rotor blades 24 disposed in the combustion gas passage 22. The stator blades 23 and the rotor blades 24 of the turbine 13 are disposed downstream of the combustors 12 in the flow direction of the combustion gas.

The stator blades 23 are fixed to the turbine casing 21, and a set of the stator blades 23 arranged along the circumferential direction of the rotor 16 forms a stator blade array. Further, the rotor blades 24 are implanted on the rotor 16, and a set of the rotor blades 24 arranged along the circumferential direction of the rotor 16 forms a rotor blade array. The stator blade arrays and the rotor blade arrays are arranged alternately in the axial direction of the rotor 16.

In the turbine 13, as the combustion gas introduced from the combustor 12 into the combustion gas passage 22 passes through the plurality of stator blades 23 and the plurality of rotor blades 24, the rotor 16 is rotationally driven. Thereby, the generator connected to the rotor 16 is driven to generate power. The combustion gas having driven the turbine 13 is discharged outside via the exhaust casing 3.

(Exhaust Casing)

Figure 2:
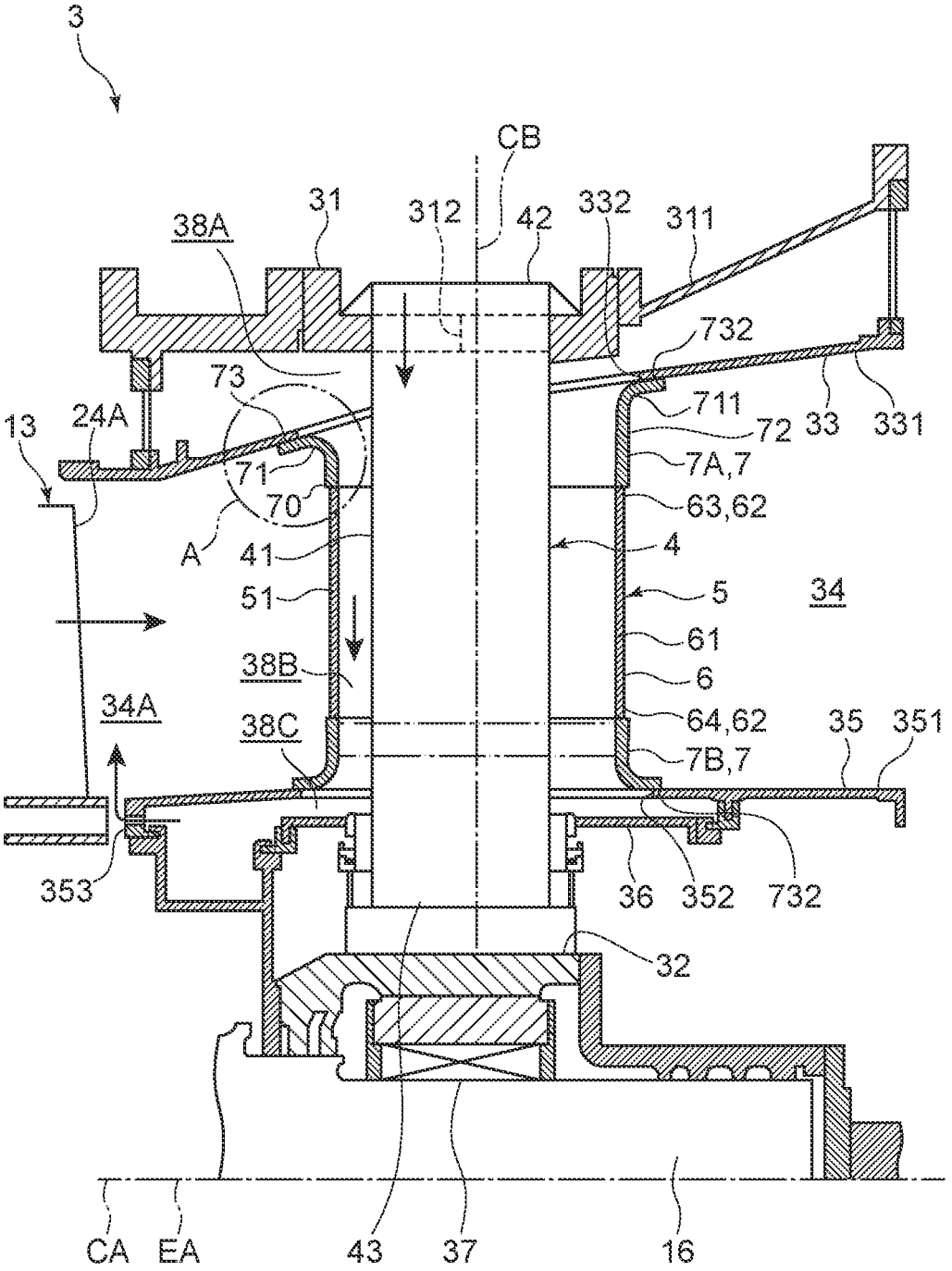
FIG. 2 is a schematic cross-sectional view of an exhaust casing according to an embodiment, in a cross-section including the center axis of the exhaust casing.
Figure 3:
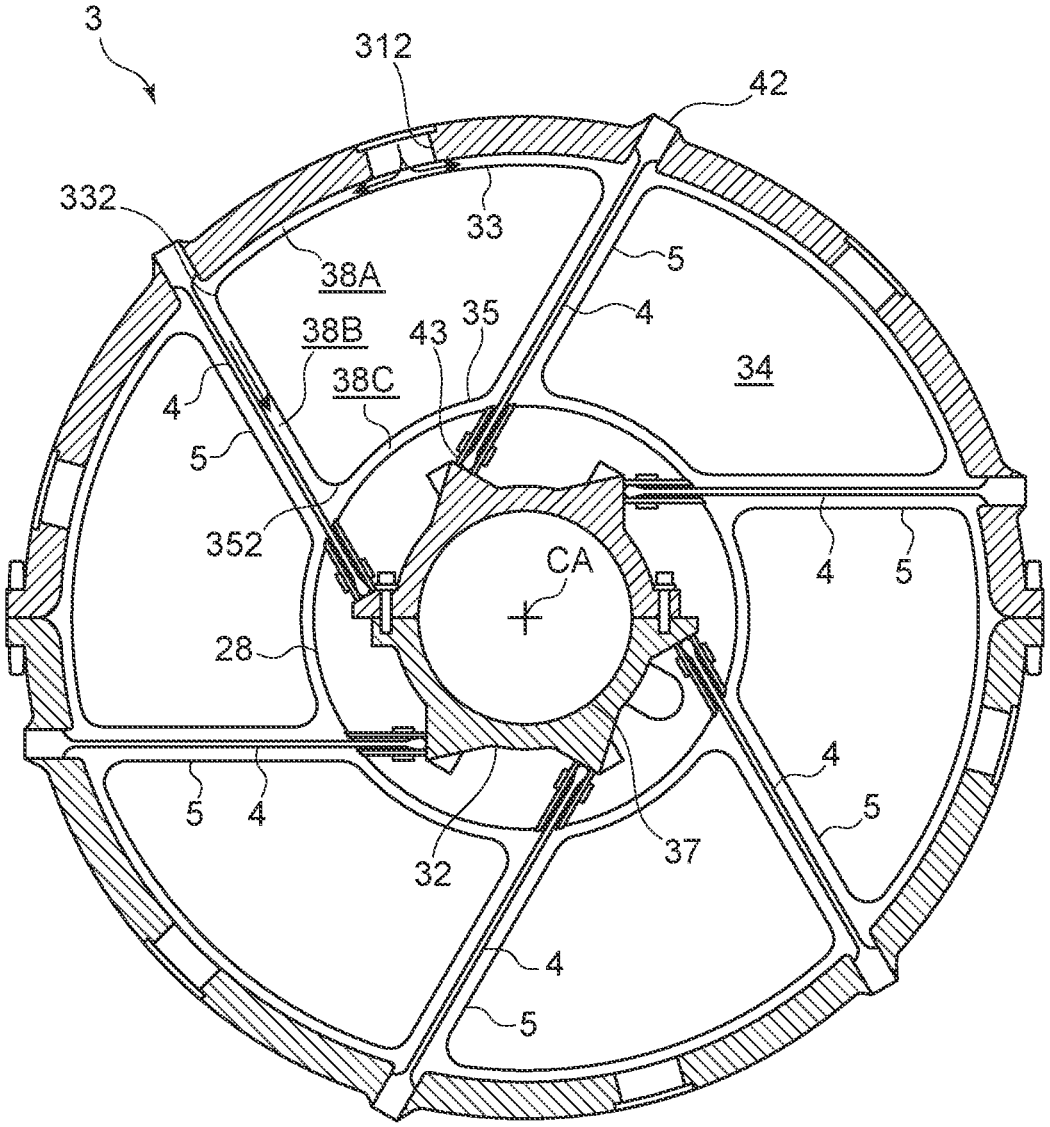
FIG. 3 is a schematic diagram of an exhaust casing according to an embodiment, viewed from the axial direction.

FIG. 2 is a schematic cross-sectional view of an exhaust casing according to an embodiment, in a cross-section including the axis of the exhaust casing. FIG. 3 is a schematic diagram of an exhaust casing according to an embodiment, viewed from the axial direction.

As shown in FIG. 1, the exhaust casing 3 according to some embodiments is disposed downstream of the stator blades 23 and the rotor blades 24 of the turbine 13 in the flow direction of the combustion gas. Hereinafter, upstream (the left side in FIG. 2) in the flow direction of the combustion gas may be simply referred to as "upstream", and downstream (the right side in FIG. 2) in the flow direction of the combustion gas may be simply referred to as "downstream".

As shown in FIG. 2, the exhaust casing 3 includes a cylindrical casing wall 31 extending along the axial direction of the rotor 16 (the direction of extension of the center axis CA of the rotor 16, or the right-left direction in FIG. 2), a bearing casing 32 disposed on the radially inner side of the casing wall 31, at least one strut 4 connecting the casing wall 31 and the bearing casing 32, and at least one strut cover 5 covering an outer surface 41 of the strut 4.

The exhaust casing 3 further includes a cylindrical outer diffuser 33 disposed on the radially inner side of the casing wall 31, a cylindrical inner diffuser 35 disposed on the radially inner side of the outer diffuser 33 and forming a diffuser passage 34 between the inner diffuser 35 and the outer diffuser 33, and a partition wall 36 disposed between the inner diffuser 35 and the bearing casing 32. The outer diffuser 33, the inner diffuser 35, and the partition wall 36 each extend along the axial direction of the rotor 16. The strut cover 5 connects the outer diffuser 33 and the inner diffuser 35.

In the illustrated embodiment, each of the casing wall 31 and the bearing casing 32 is formed in a cylindrical shape centered on the center axis CA. The casing wall 31 has an outer wall surface 311 that forms the outer shape of the exhaust casing 3. The bearing casing 32 accommodates a bearing portion 37 and supports the bearing portion 37 in a non-rotatable manner. The bearing portion 37 supports the rotor 16 in a rotatable manner.

The diffuser passage 34 is configured to be supplied with combustion gas that has passed through the final stage rotor blade 24A of the turbine 13, and is formed in an annular shape in which the cross-sectional area gradually expands toward the downstream side. When the combustion gas is supplied to the diffuser passage 34, the speed of the gas decreases, and kinetic energy of the gas is converted to pressure (static pressure recovery).

In the illustrated embodiment, each of the outer diffuser 33 and the inner diffuser 35 is formed in a cylindrical shape centered on the center axis CA. The outer diffuser 33 has an inner wall surface 331 with a distance from the center axis CA gradually increasing toward the downstream side. The inner diffuser 35 has an outer wall surface 351 with a uniform distance from the center axis CA. The diffuser passage 34 is formed by the inner wall surface 331 of the outer diffuser 33 and the outer wall surface 351 of the inner diffuser 35, and has a shape that gradually expands outward in the radial direction as it extends downstream.

As shown in FIGS. 2 and 3, the at least one strut 4 has one end 42 in the longitudinal direction fixed to the casing wall 31 and the other end 43 in the longitudinal direction fixed to the bearing casing 32. The bearing casing 32 is supported by the casing wall 31 via the strut 4.

In the illustrated embodiment, as shown in FIG. 3, the strut 4 extends along the tangential direction of the bearing casing 32. In other words, the strut 4 extends from the other end 43 toward one side in the circumferential direction as it goes outward in the radial direction. The strut cover 5 extends along the extension direction of the strut 4 (the tangential direction of the bearing casing 32). Alternatively, in some embodiments, each of the strut 4 and the strut cover 5 may extend along the radial direction.

In the illustrated embodiment, the at least one strut 4 includes a plurality of (six in the figure) struts 4 spaced from each other in the circumferential direction. Further, the at least one strut cover 5 includes a plurality of (six in the figure) strut covers 5 spaced from each other in the circumferential direction.

The strut 4 is disposed so as to penetrate the outer diffuser 33 and the inner diffuser 35 and traverse the diffuser passage 34. The outer diffuser 33 is formed with a communication hole 332 that connects the inside and the outside in the radial direction, and the strut 4 is inserted through the communication hole 332. The inner diffuser 35 is formed with a communication hole 352 that connects the inside and the outside in the radial direction, and the strut 4 is inserted through the communication hole 352.

In the illustrated embodiment, components (e.g., outer diffuser 33, inner diffuser 35, strut 4 and strut cover 5) disposed inside the exhaust casing 3 are cooled by flowing cooling air inside the exhaust casing 3.

In the embodiment shown in FIG. 2, the casing wall 31 has an intake port 312 for taking in cooling air from the outside. The intake port 312 penetrates the inside and outside of the casing wall 31 in the radial direction. The outer diffuser 33 is radially inwardly spaced from the casing wall 31, and a first cooling passage 38A is formed between the outer diffuser 33 and the casing wall 31. The strut cover 5 has an inner surface 51 separated from the outer surface 41 of the strut 4, and a second cooling passage 38B is formed between the strut cover 5 and the strut 4. The inner diffuser 35 is radially outwardly spaced from the partition wall 36, and a third cooling passage 38C is formed between the inner diffuser 35 and the partition wall 36.

The first cooling passage 38A communicates with the intake port 312 and is configured to pass cooling air introduced from the intake port 312. The second cooling passage 38B communicates with the first cooling passage 38A through the communication hole 332 and is configured to pass the cooling air. The third cooling passage 38C communicates with the second cooling passage 38B through the communication hole 352 and is configured to pass the cooling air.

The cooling air introduced from the intake port 312 into the exhaust casing 3 flows through the first cooling passage 38A, the second cooling passage 38B, and the third cooling passage 38C in this order, and cools the components (e.g., outer diffuser 33, inner diffuser 35, strut 4, and strut cover 5) facing these cooling passages 38A, 38B, and 38C to suppress the temperature rise of the components.

In the illustrated embodiment, the inner diffuser 35 has a discharge port 353 for discharging the cooling air to the diffuser passage 34. The discharge port 353 penetrates the inside and outside of the inner diffuser 35 in the radial direction, and connects an upstream diffuser inlet portion 34A of the diffuser passage 34 and the third cooling passage 38C. Since the diffuser inlet portion 34A is adjust to the final stage rotor blade 24A of the turbine 13, the pressure of the combustion gas in the diffuser inlet portion 34A is negative pressure compared to the static pressure. Due to the pressure difference between the air outside the exhaust casing 3 and the negative pressure, the outside air is introduced through the intake port 312 as the cooling air, and after passing through the cooling passages 38A, 38B, and 38C, is discharged through the discharge port 353.

(Strut Cover)

Figure 4:
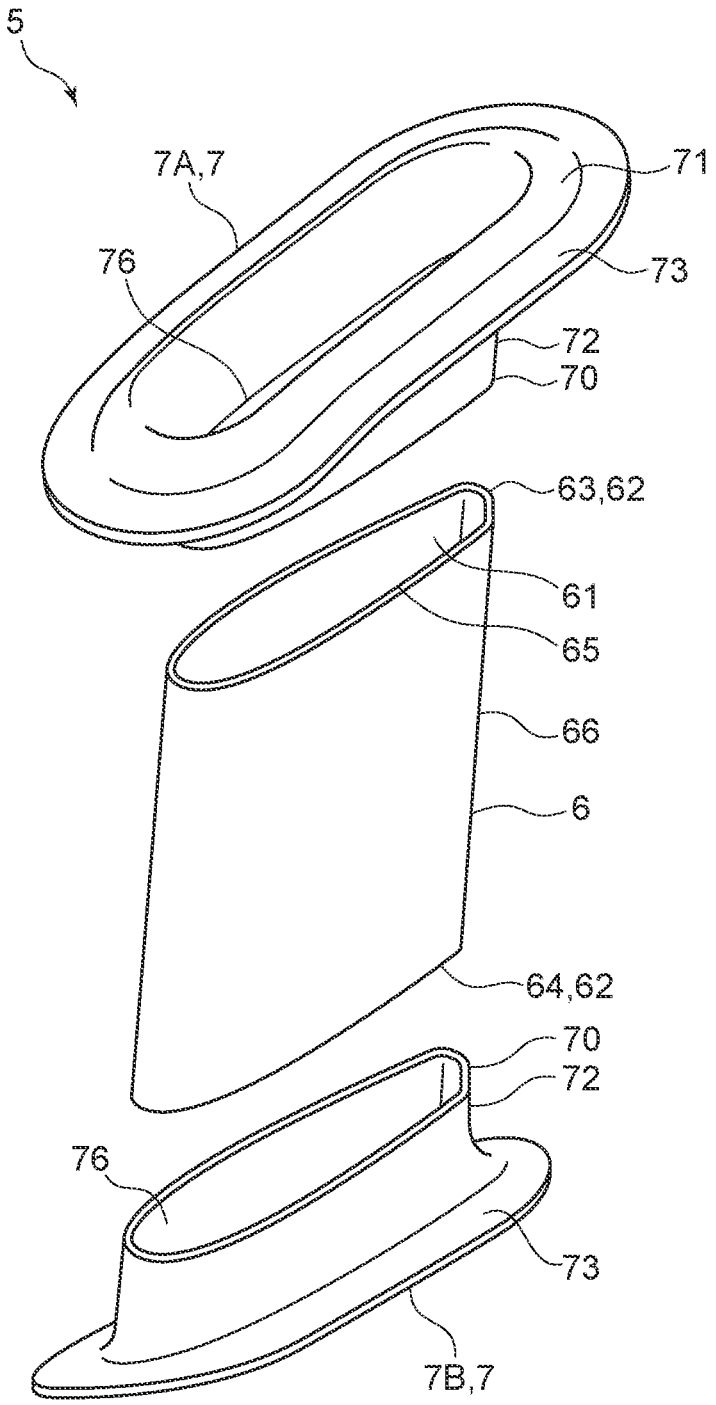
FIG. 4 is a schematic exploded perspective view of a strut cover according to an embodiment.
Figure 5:
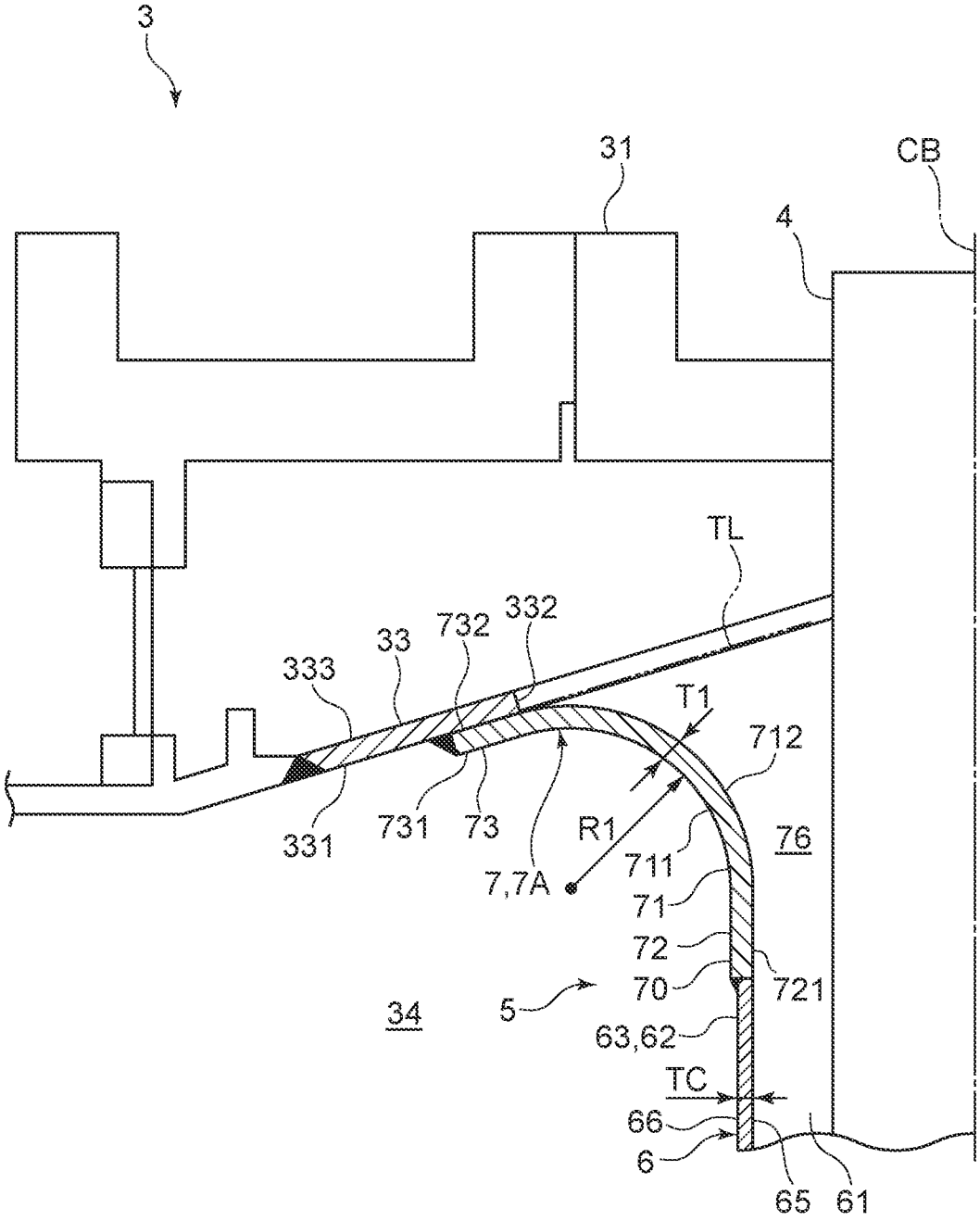
FIG. 5 is a schematic cross-sectional view of a strut cover according to an embodiment, in a cross-section including the center axis of the strut cover.
Figure 6:
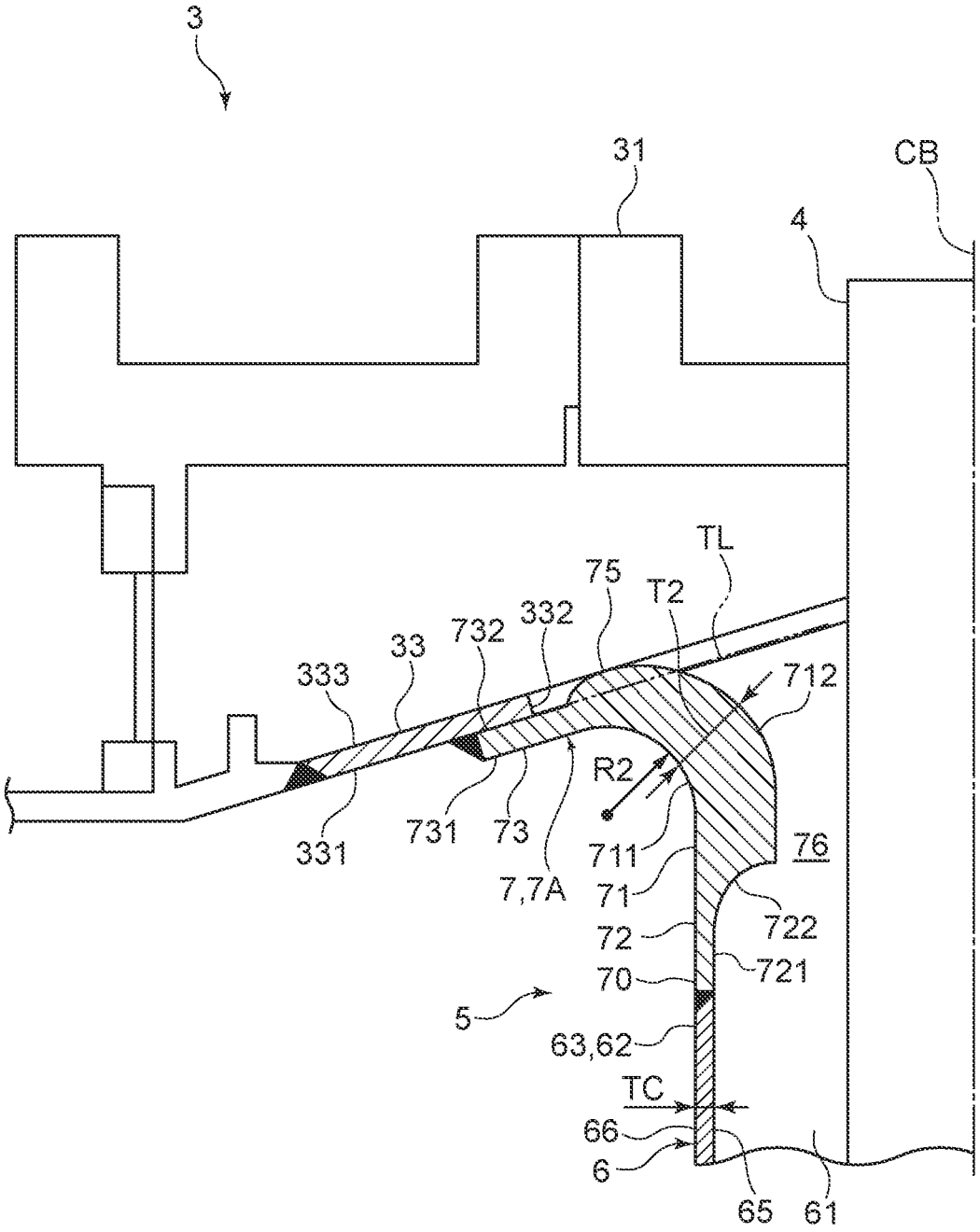
FIG. 6 is a schematic cross-sectional view of a strut cover according to an embodiment, in a cross-section including the center axis of the strut cover.
Figure 7:
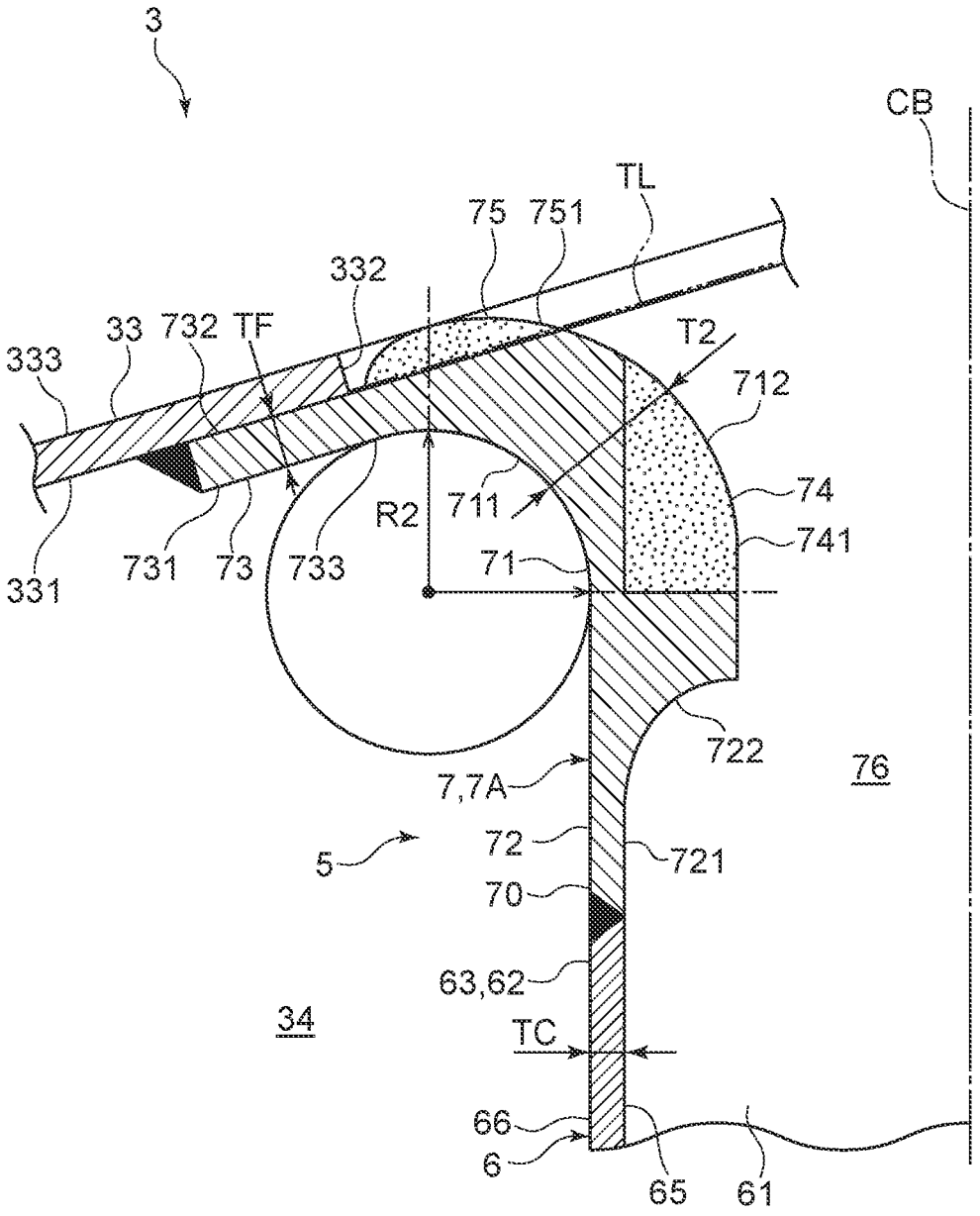
FIG. 7 is an explanatory diagram for describing a strut cover according to an embodiment.

FIG. 4 is a schematic exploded perspective view of the strut cover according to an embodiment. FIGS. 5 and 6 are schematic cross-sectional views of the strut cover according to an embodiment, in a cross-section including the center axis of the strut cover. FIG. 7 is an explanatory diagram for describing the strut cover according to an embodiment. FIGS. 5 to 7 each show the enlargement of portion A in FIG. 2.

The strut cover 5 according to some embodiments includes, for example as shown in FIG. 2, a cylindrical sheet metal member 6 having a hollow portion 61, and a flare member 7 that is connected to one end 62 of the cylindrical sheet metal member 6 in the axial direction (the direction of extension of the center axis CB of the cylindrical sheet metal member 6) and includes a curved portion 71 having an outer surface 711 such that a distance from the center axis CB of the cylindrical sheet metal member 6 to the outer surface 711 increases with increasing a distance from the cylindrical sheet metal member 6 in the axial direction.

The cylindrical sheet metal member 6 is formed in a cylindrical shape extending along the axial direction of the cylindrical sheet metal member 6, and is shaped by sheet metal processing. That is, the cylindrical sheet metal member 6 is a sheet metal part. Since the cylindrical sheet metal member 6 is formed by sheet metal processing, the thickness can be reduced. The hollow portion 61 of the cylindrical sheet metal member 6 is defined by the inner surface 65 of the cylindrical sheet metal member 6.

In the illustrated embodiment, for example as shown in FIG. 2, the flare member 7 includes the above-described curved portion 71, a connection end 70 connected to one end 62 of the cylindrical sheet metal member 6, a flange portion 73 disposed on the opposite side of the curved portion 71 from the connection end 70, and a cylindrical portion 72 extending along the center axis CB between the curved portion 71 and the connection end 70. The flange portion 73 is connected to either the outer diffuser 33 or the inner diffuser 35. Further, the flare member 7 is formed in a cylindrical shape having a hollow portion 76.

In the illustrated embodiment, for example as shown in FIG. 2, the cylindrical sheet metal member 6 and the flare member 7 are fixed by abutting one end 62 of the cylindrical sheet metal member 6 on the connection end 70 of the flare member 7 and joining them by welding. Further, the flare member 7 is fixed to the outer diffuser 33 or the inner diffuser 35 by superimposing the flange portion 73 of the flare member 7 on the outer diffuser 33 or the inner diffuser 35 and joining them by welding.

In the illustrated embodiment, for example as shown in FIG. 2, the flare member 7 includes an outer flare member 7A having the connection end 70 connected to an upper end 63 of the cylindrical sheet metal member 6 and the flange portion 73 connected to the outer diffuser 33, and an inner flare member 7B having the connection end 70 connected to a lower end 64 of the cylindrical sheet metal member 6 and the flange portion 73 connected to the inner diffuser 35. That is, the strut cover 5 includes the cylindrical sheet metal member 6, the outer flare member 7A, and the inner flare member 7B, and the shape is formed by connecting these components to each other.

In the illustrated embodiment, for example as shown in FIG. 2, the flange portion 73 of the outer flare member 7A extends linearly along the inner wall surface 331 of the outer diffuser 33, and has an inner surface 732 in contact with the inner wall surface 331. The flange portion 73 of the inner flare member 7B extends linearly along the outer wall surface 351 of the inner diffuser 35, and has an inner surface 732 in contact with the outer wall surface 351.

The strut 4 is inserted into the hollow portion 61 of the cylindrical sheet metal member 6 and the hollow portion 76 of the flare member 7, and the second cooling passage 38B is formed between the hollow portion 61 and the inserted strut 4.

The strut cover 5 according to some embodiments includes, for example as shown in FIGS. 5 to 7, the cylindrical sheet metal member 6 having the hollow portion 61, and the flare member 7 that is connected to one end 62 of the cylindrical sheet metal member 6 in the axial direction and includes the curved portion 71 having the outer surface 711 such that the distance from the center axis CB of the cylindrical sheet metal member 6 to the outer surface 711 increases with increasing the distance from the cylindrical sheet metal member 6 in the axial direction. The flare member 7 has a thickness larger than the minimum thickness TC of the cylindrical sheet metal member 6 at least in the curved portion 71.

In the embodiment shown in FIG. 5, the flare member 7 has a thickness larger than the minimum thickness TC of the cylindrical sheet metal member 6 in each of the curved portion 71, the connection end 70, and the flange portion 73. The flare member 7 shown in FIG. 5 is easy to form by sheet metal processing since the curved portion 71, the connection end 70, and the flange portion 73 each have a uniform thickness. Since the flare member 7 can be easily formed by casting, it may be formed by casting.

In the embodiment shown in FIG. 6, the flare member 7 has the same thickness as the minimum thickness TC of the cylindrical sheet metal member 6 in the connection end 70, and has a thickness larger than the minimum thickness TC of the cylindrical sheet metal member 6 in each of the curved portion 71 and the flange portion 73. The flare member 7 shown in FIG. 6 is difficult to form by sheet metal processing since the curved portion 71, the connection end 70, and the flange portion 73 have non-uniform thickness. Since the flare member 7 can be easily formed by casting, it may be formed by casting.

According to the above configuration, the strut cover 5 includes the cylindrical sheet metal member 6 having the hollow portion 61 and the flare member 7. The flare member 7 has a thickness larger than the minimum thickness TC of the cylindrical sheet metal member 6 at least in the curved portion 71. In this case, since the curved portion 71 of the flare member 7 is thick, the stress generated in the curved portion 71 can be reduced. By reducing the stress generated in the curved portion 71, it is possible to improve the high cycle fatigue strength of the strut cover 5.

Further, according to the above configuration, the wall thickness of the cylindrical sheet metal member 6 can be reduced compared to a casting part formed by casting. By reducing the wall thickness of the cylindrical sheet metal member 6, the outer surface 66 (see FIGS. 5 and 6) can be brought closer to the center axis CB of the cylindrical sheet metal member, and thus the reduction in the flow-passage cross-sectional area of the diffuser passage 34 can be suppressed. By suppressing the reduction in the flow-passage cross-sectional area of the diffuser passage 34, it is possible to suppress the reduction in performance of the gas turbine 1.

In some embodiments, as shown in FIG. 7, the inner surface 712 of the curved portion 71 of the flare member 7 protrudes toward the center axis CB of the cylindrical sheet metal member 6 with respect to the inner surface 65 of the cylindrical sheet metal member 6. As shown in FIG. 7, the portion of the curved portion 71 of the flare member 7 that protrudes toward the center axis CB of the cylindrical sheet metal member 6 with respect to the inner surface 65 of the cylindrical sheet metal member 6 is referred to as a thick-walled portion 74. The portion including the thick-walled portion 74 of the curved portion 71 has a thickness larger than the minimum thickness TC of the cylindrical sheet metal member 6.

According to the above configuration, since the inner surface 712 of the curved portion 71 of the flare member 7 protrudes toward the center axis CB with respect to the inner surface 65 of the cylindrical sheet metal member 6, the thickness of the curved portion 71 can be increased while suppressing the reduction in the flow-passage cross-sectional area of the diffuser passage 34 due to an increase in distance of the outer surface 711 of the curved portion 71 from the center axis CB.

In some embodiments, as shown in FIG. 7, in a cross-section along the center axis CB, the curved portion 71 of the flare member 7 includes a thick-walled portion 74 that protrudes toward the center axis CB of the cylindrical sheet metal member 6 with respect to the inner surface 65 of the cylindrical sheet metal member 6, and an inner surface 741 of the thick-walled portion 74 curves convexly.

According to the above configuration, since the inner surface 741 of the thick-walled portion 74 of the flare member 7 curves convexly, the thick-walled portion 74 is prevented from becoming excessively thick. By preventing the thick-walled portion 74 from becoming excessively thick, the thermal stress caused by the temperature difference between the inner surface 741 facing the second cooling passage 38B of the thick-walled portion 74 and the outer surface 711 disposed on the opposite side from the inner surface 741 in the thickness direction can be reduced. By reducing the thermal stress generated in the flare member 7, it is possible to improve the high cycle fatigue strength of the strut cover 5.

Further, according to the above configuration, since the inner surface 741 of the thick-walled portion 74 of the flare member 7 curves convexly, the shape change of the inner surface 741 is gradual, and the stress concentration in the flare member 7 can be relaxed. By relaxing the stress concentration in the flare member 7, it is possible to improve the high cycle fatigue strength of the strut cover 5.

In some embodiments, as shown in FIG. 7, the flare member 7 includes the curved portion 71, the connection end 70, and the cylindrical portion 72 extending along the center axis CB between the curved portion 71 and the connection end 70. The inner surface 721 of the cylindrical portion 72 includes a surface 722 such that the distance from the center axis CB of the cylindrical sheet metal member 6 increases with increasing the distance from the cylindrical sheet metal member 6 in the axial direction of the cylindrical sheet metal member 6. In the embodiment shown in FIG. 7, the surface 722 curves concavely. In an embodiment shown in FIGS. 9 and 10, described later, the surface 722 is formed in a tapered shape. In this case, since the shape change of the inner surface 721 (surface 722) of the cylindrical portion 72 located between the inner surface 65 of the cylindrical sheet metal member 6 and the inner surface 712 of the curved portion 71 is gradual, the stress concentration in the flare member 7 can be relaxed. By relaxing the stress concentration in the flare member 7, it is possible to improve the high cycle fatigue strength of the strut cover 5.

In some embodiments, as shown in FIG. 7, the flare member 7 includes the curved portion 71, the connection end 70 connected to the cylindrical sheet metal member 6, and the flange portion 73 disposed on the opposite side of the curved portion 71 from the connection end 70. As shown in FIG. 7, in a cross-section along the center axis CB, the flare member 7 bulges on the opposite side of the tangential line TL to the inner surface 732 of the flange portion 73 in an outer peripheral region 731 of the flange portion 73 from the cylindrical sheet metal member 6. As shown in FIG. 7, the portion of the flare member 7 that bulges on the opposite side of the tangential line TL from the cylindrical sheet metal member 6 is referred to as a bulge portion 75. In the illustrated embodiment, each of the curved portion 71 and the flange portion 73 includes a portion of the bulge portion 75. The portion including the bulge portion 75 of the flare member 7 has a thickness larger than the minimum thickness TC of the cylindrical sheet metal member 6 and the thickness TF of the outer peripheral region 731 of the flange portion 73.

According to the above configuration, in a cross-section along the center axis CB, since the flare member 7 bulges on the opposite side of the tangential line TL from the cylindrical sheet metal member 6, the thickness of the portion including the bulge portion 75 of the flare member 7 can be increased while suppressing the reduction in the flow-passage cross-sectional area of the diffuser passage 34 due to an increase in distance of the outer surface of the curved portion 71 (outer surface 711 of curved portion 71 or outer surface 733 of flange portion 73) from the tangential line TL.

In some embodiments, as shown in FIG. 7, in a cross-section along the center axis CB, the flare member 7 includes the bulge portion 75 that bulges on the opposite side of the tangential line TL from the cylindrical sheet metal member 6, and an inner surface 751 of the bulge portion 75 curves convexly.

According to the above configuration, since the inner surface 751 of the bulge portion 75 of the flare member 7 curves convexly, the bulge portion 75 is prevented from becoming excessively thick. By preventing the bulge portion 75 from becoming excessively thick, the thermal stress caused by the temperature difference between the inner surface 751 facing the cooling passage of the bulge portion 75 (e.g., first cooling passage 38A) and the outer surface (e.g., outer surface 711, 733) disposed on the opposite side from the inner surface 751 in the thickness direction can be reduced. By reducing the thermal stress generated in the flare member 7, it is possible to improve the high cycle fatigue strength of the strut cover 5.

Further, according to the above configuration, since the inner surface 751 of the bulge portion 75 of the flare member 7 curves convexly, the shape change of the inner surface 751 is gradual, and the stress concentration in the flare member 7 can be relaxed. By relaxing the stress concentration in the flare member 7, it is possible to improve the high cycle fatigue strength of the strut cover 5.

Figure 8:
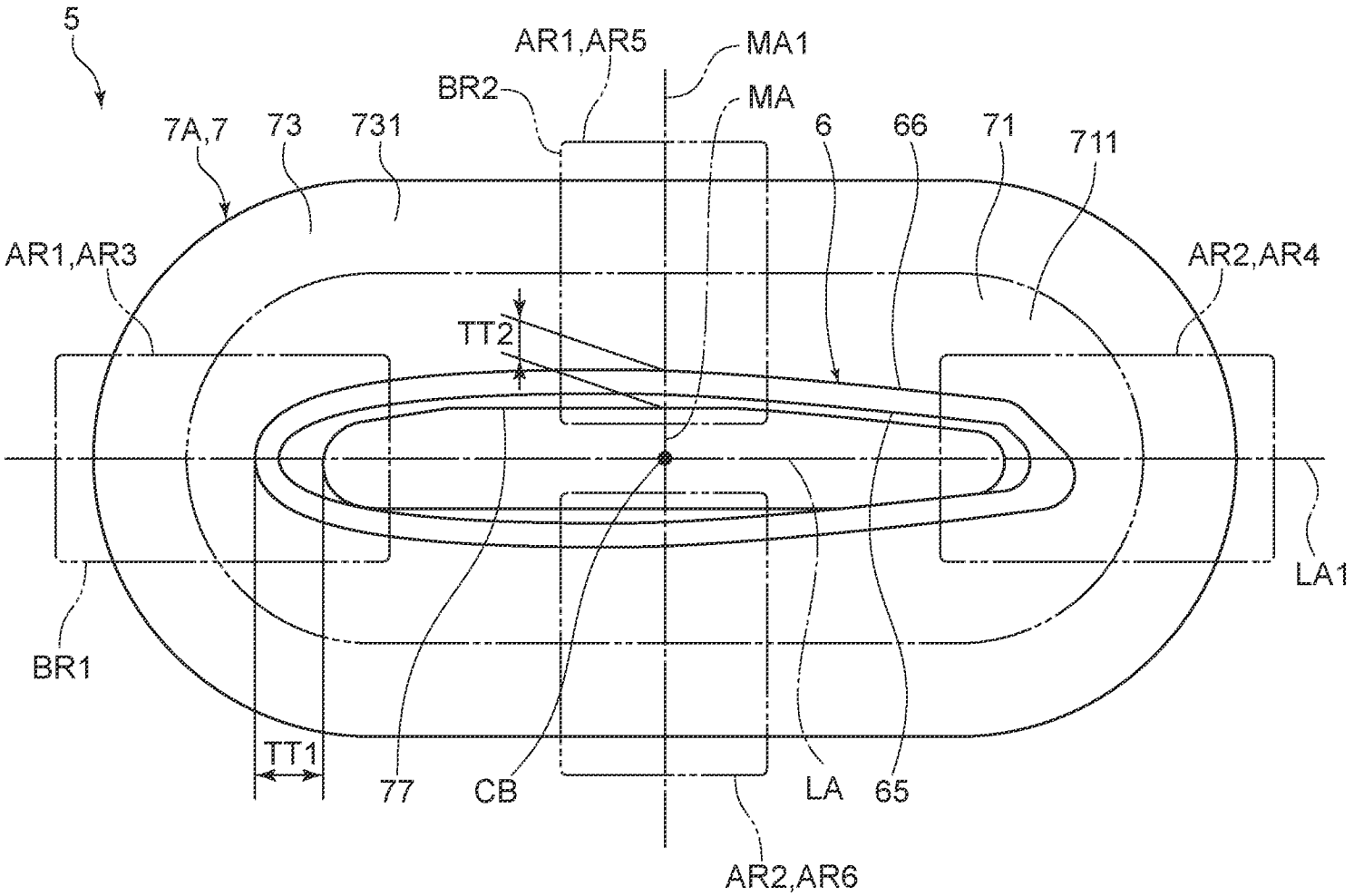
FIG. 8 is a schematic diagram of a flare member of a strut cover according to an embodiment, viewed from the direction of extension of the center axis of the flare member.
Figure 9:
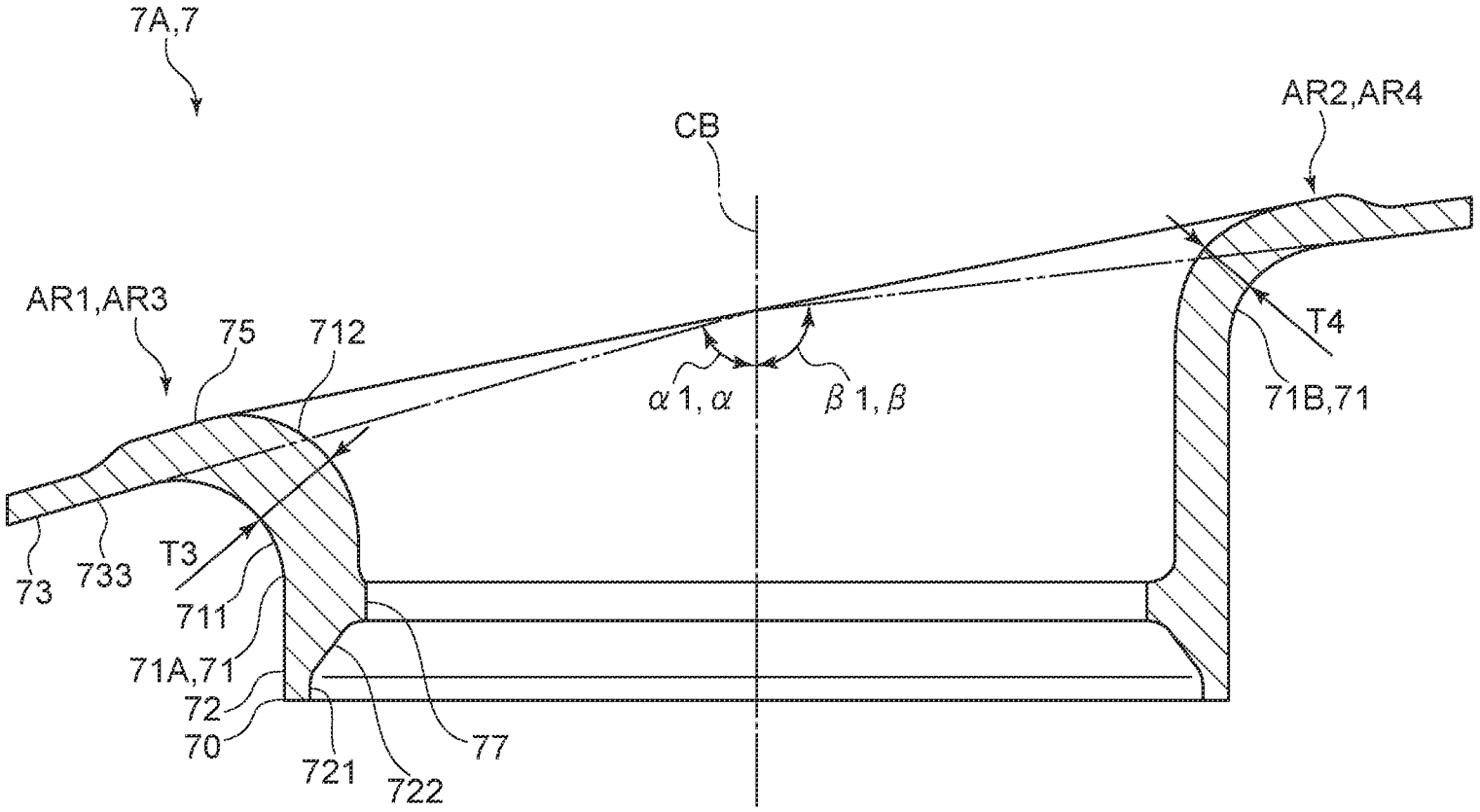
FIG. 9 is a schematic cross-sectional view showing a cross-section along the major axis of the hollow portion of the flare member according to an embodiment.
Figure 10:
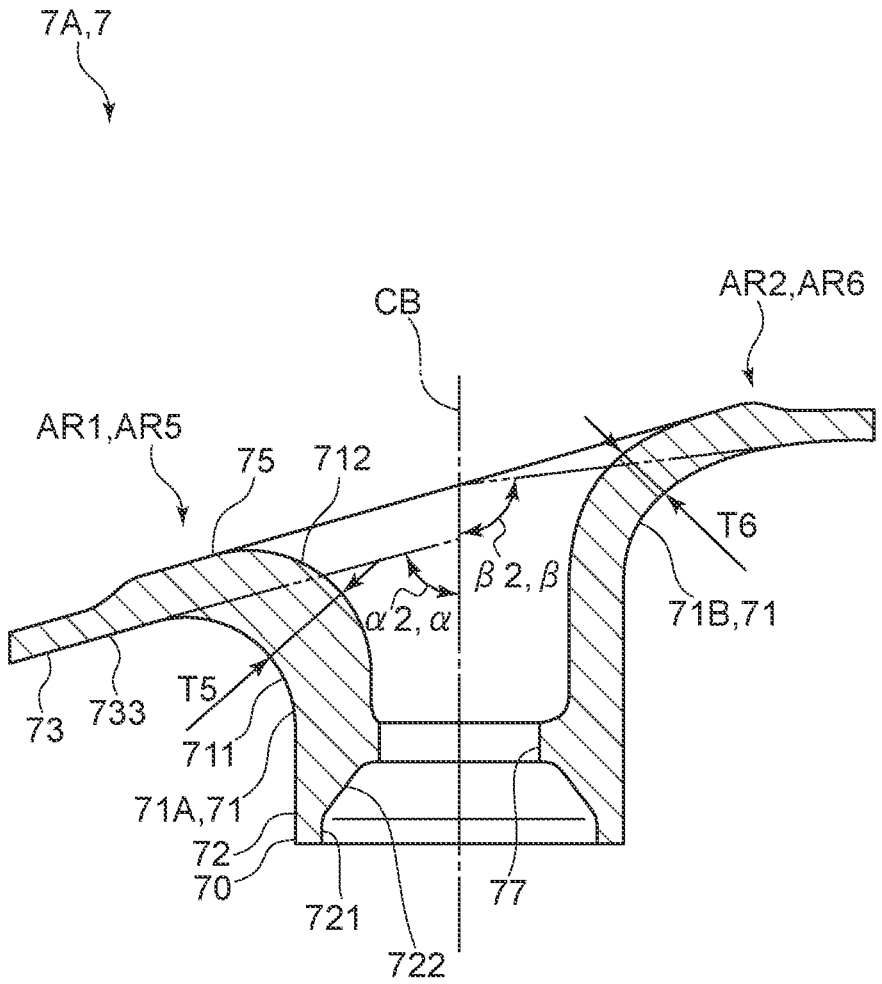
FIG. 10 is a schematic cross-sectional view showing a cross-section along the minor axis of the hollow portion of the flare member according to an embodiment.

FIG. 8 is a schematic diagram of the flare member of the strut cover according to an embodiment, viewed from the direction of extension of the center axis of the flare member. FIG. 9 is a schematic cross-sectional view showing a cross-section along the major axis of the hollow portion of the flare member according to an embodiment. FIG. 10 is a schematic cross-sectional view showing a cross-section along the minor axis of the hollow portion of the flare member according to an embodiment.

In some embodiments, for example as shown in FIGS. 9 and 10, the flare member 7 includes the curved portion 71, the connection end 70 connected to the cylindrical sheet metal member 6, and the flange portion 73 disposed on the opposite side of the curved portion 71 from the connection end 70. The flare member 7 includes a first region AR1 (see FIG. 8) where the tangential direction to the outer surface 733 of the flange portion 73 and the center axis CB makes a first angle $\alpha$, and a second region AR2, disposed so as to face the first region AR1 with the center axis CB therebetween, where the tangential direction to the outer surface 733 of the flange portion 73 and the center axis CB makes a second angle $\beta$ (see FIG. 8) that is larger than the first angle $\alpha$, and the curved portion 71 has a smaller thickness in the second region AR2 than in the first region AR1.

As shown in FIG. 8, in a cross-section perpendicular to the center axis CB, the hollow portion 61 has a minor axis MA and a major axis LA larger than the minor axis MA.

The region AR3 and the region AR4 of the flare member 7 face each other in the direction along the major axis LA of the hollow portion 61 (in the right-left direction in FIG. 8), with the center axis CB therebetween. The region AR3 is disposed on one side (the left side in FIGS. 8 and 9) in the direction along the major axis LA, and the region AR4 is disposed on the other side (the right side in FIGS. 8 and 9) in the direction along the major axis LA.

The region AR5 and the region AR6 of the flare member 7 face each other in the direction along the minor axis MA of the hollow portion 61 (in the up-down direction in FIG. 8), with the center axis CB therebetween. The region AR5 is disposed on one side (the up side in FIG. 8 and the left side in FIG. 10) in the direction along the minor axis MA, and the region AR6 is disposed on the other side (the down side in FIG. 8 and the right side in FIG. 10) in the direction along the minor axis MA.

Hereinafter, for example as shown in FIGS. 9 and 10, the curved portion 71 in the first region AR1 may be referred to as a curved portion 71A, and the curved portion 71 in the second region AR2 may be referred to as a curved portion 71B.

In the illustrated embodiment, as shown in FIGS. 8 and 9, the first region AR1 includes the region AR3, and the second region AR2 includes the region AR4.

As shown in FIG. 9, the angle $\beta$1 (second angle $\beta$) between the tangential direction to the outer surface 733 of the flange portion 73 and the center axis CB in the region AR4 is larger than the angle $\alpha$1 (first angle $\alpha$) between the tangential direction to the outer surface 733 of the flange portion 73 and the center axis CB in the region AR3. Further, the thickness T3 of the curved portion 71 (71A) in the region AR3 is larger than the thickness T4 of the curved portion 71 (71B) in the region AR4.

In the illustrated embodiment, as shown in FIGS. 8 and 10, the first region AR1 includes the region AR5, and the second region AR2 includes the region AR6.

As shown in FIG. 10, the angle β2 (second angle β between the tangential direction to the outer surface 733 of the flange portion 73 and the center axis CB in the region AR6 is larger than the angle α2 (first angle α) between the tangential direction to the outer surface 733 of the flange portion 73 and the center axis CB in the region AR5. Further, the thickness T5 of the curved portion 71 (71A) in the region AR5 is larger than the thickness T6 of the curved portion 71 (71B) in the region AR6.

According to the above configuration, the angle between the tangential direction to the outer surface 733 of the flange portion 73 and the center axis CB is larger in the second region AR2 than in the first region AR1. Therefore, the curved portion 71 (71B) in the second region AR2 is gently curved as compared to the curved portion 71 (71A) in the first region AR1, and the stress generated in the curved portion 71 is small in the second region AR2, so that the thickness of the curved portion 71 can be reduced. Thus, when the thickness of the curved portion 71 fluctuates according to the angle (first angle α and second angle β) in the first region AR1 and the second region AR2, the thickness of the curved portion 71 in each of the first region AR1 and the second region AR2 can be made appropriate while suppressing the reduction in the flow-passage cross-sectional area of the diffuser passage 34. By making the thickness of the curved portion 71 appropriate, the stress (vibration stress and thermal stress) generated in the curved portion 71 can be reduced. Thus, it is possible to improve the high cycle fatigue strength of the strut cover 5.

In some embodiments, as shown in FIG. 9, the first region AR1 (region A3) and the second region AR2 (region AR4) of the flare member 7 face each other in the direction along the major axis LA of the hollow portion 61 (in the right-left direction in FIG. 8), with the center axis CB therebetween. As shown in FIG. 9, the thickness T3 of the curved portion 71 in the region AR3 is larger than the thickness T4 of the curved portion 71 in the region AR4.

According to the above configuration, the first region AR1 (region AR3) of the flare member 7 is disposed on one side in the direction along the major axis LA, and the second region AR2 (region AR4) is disposed on the other side in the direction along the major axis LA. That is, since the angle between the tangential direction to the outer surface 733 of the flange portion 73 and the center axis CB is larger in the region AR4 disposed on the other side in the direction along the major axis LA than in the region AR3 disposed on one side in the direction along the major axis LA, the stress generated in the curved portion 71B in the region AR4 is small, and thus the thickness of the curved portion 71B in the region AR4 can be reduced. Thus, according to the above configuration, the thickness of the curved portion 71 can be made appropriate in each of the region AR3 disposed on one side in the direction along the major axis LA and the region AR4 disposed on the other side in the direction along the major axis LA.

In some embodiments, for example as shown in FIG. 2, the flare member 7 has a leading edge, on one side in the direction along the major axis LA (the side with the region AR3), disposed on the upstream side in the diffuser passage 34, and a trailing edge, on the other side in the direction along the major axis LA (the side with the region AR4), disposed on the downstream side in the diffuser passage 34. In this case, the frequency of impingement of the combustion gas flowing through the diffuser passage 34 is higher in the curved portion 71A in region AR3 than in the curved portion 71B in region AR4, so that the force acting on the curved portion 71A in region AR3 is increased. However, since the curved portion 71A in the region AR3 is thicker than the curved portion 71B in the region AR4, the stress generated in the curved portion 71A in the region AR3 can be reduced, so that it is possible to improve the high cycle fatigue strength of the strut cover 5.

In some embodiments, as shown in FIG. 10, the first region AR1 (region A5) and the second region AR2 (region AR6) of the flare member 7 face each other in the direction along the minor axis MA of the hollow portion 61 (in the up-down direction in FIG. 8), with the center axis CB therebetween. As shown in FIG. 10, the thickness T5 of the curved portion 71 in the region AR5 is larger than the thickness T6 of the curved portion 71 in the region AR6.

According to the above configuration, the first region AR1 (region AR5) of the flare member 7 is disposed on one side in the direction along the minor axis MA, and the second region AR2 (region AR6) is disposed on the other side in the direction along the minor axis MA. That is, since the angle between the tangential direction to the outer surface 733 of the flange portion 73 and the center axis CB is larger in the region AR6 disposed on the other side in the direction along the minor axis MA than in the region AR5 disposed on one side in the direction along the minor axis MA, the stress generated in the curved portion 71B in the region AR6 is small, and thus the thickness of the curved portion 71B in the region AR6 can be reduced. Thus, according to the above configuration, the thickness of the curved portion 71 can be made appropriate in each of the region AR5 disposed on one side in the direction along the minor axis MA and the region AR6 disposed on the other side in the direction along the minor axis MA.

Further, according to the above configuration, as shown in FIG. 3, when the strut cover 5 extends along the tangential direction, the strut cover 5 can be suitably connected to the outer diffuser 33.

In some embodiments, the flare member 7 includes the curved portion 71, the connection end 70 connected to the cylindrical sheet metal member 6, and the cylindrical portion 72 extending along the center axis CB between the curved portion 71 and the connection end 70. As shown in FIG. 8, the flare member 7 includes a third region BR1 intersecting a straight line LA1 extending from the center axis CB in the direction along the major axis LA in a cross-section perpendicular to the center axis CB, and a fourth region BR2 intersecting a straight line MA1 extending from the center axis CB in the direction along the minor axis MA in a cross-section perpendicular to the center axis CB, and the cylindrical portion 72 has a smaller thickness in the fourth region BR2 than in the third region BR1. In the illustrated embodiment, between the third region BR1 and the fourth region BR2, the maximum thickness of the cylindrical portion 72 in each region is compared, but in some embodiments, the minimum thickness of the cylindrical portion 72 in each region may be compared, or the average or median values may be compared.

According to the above configuration, the combustion gas flowing through the diffuser passage 34 has not only a velocity component along the axial direction of the exhaust casing 3 (the axial direction of the rotor 16) but also a velocity component that swirls along the circumferential direction. Therefore, when the combustion gas impinges on the strut cover 5, the impingement force acts to twist the strut cover 5. Thus, a larger force acts on the major axis end of the flare member 7, that is, the third region BR1, than on the minor axis end of the flare member 7, that is, the fourth region BR2. By making the thickness TT1 of the cylindrical portion 72 in the third region BR1 larger than the thickness TT2 of the cylindrical portion 72 in the fourth region BR2, the stress generated in the third region BR1 can be reduced, so that it is possible to improve the high cycle fatigue strength of the strut cover 5.

In some embodiments, for example as shown in FIGS. 8 to 10, the cylindrical portion 72 includes an inner peripheral rib 77 protruding toward the center axis CB and extending along the circumferential direction around the center axis CB. In the illustrated embodiment, the inner peripheral rib 77 extends over the entire circumference. According to the above configuration, the inner peripheral rib 77 improves the stiffness and strength of the flare member 7, and the thickness of the cylindrical portion 72 can be reduced accordingly.

In some embodiments, the flare member 7 is a casting part formed by casting. Here, the flare member 7 which is a sheet metal part formed by sheet metal processing, for example as shown in FIG. 5, is difficult to make thicker, so the curvature radius R1 of the outer surface 711 of the curved portion 71 needs to be increased in order to reduce the stress generated in the curved portion 71. In contrast, the flare member 7 (7A) which is a casting part, for example as shown in FIG. 6, is easy to make thicker, so the thickness T2 of the curved portion 71 can be made larger than the thickness T1 of the curved portion 71 shown in FIG. 5, and the curvature radius R2 of the outer surface 711 of the curved portion 71 can be made smaller than the curvature radius R1. By reducing the curvature radius R2 of the outer surface 711 of the curved portion 71, the reduction in the flow-passage cross-sectional area of the diffuser passage 34 can be effectively suppressed.

According to the above configuration, since the flare member 7 is a casting part, the wall thickness can be easily increased compared to a sheet metal part formed by sheet metal processing. Further, the flare member 7 which is a casting part allows the curvature radius of the outer surface of the curved portion to be reduced compared to a sheet metal part, the reduction in the flow-passage cross-sectional area of the diffuser passage can be effectively suppressed. Either one of the outer flare member 7A or the inner flare member 7B may be a casting part, and the other may be a sheet metal part.

As shown in FIG. 2, the exhaust casing 3 of the gas turbine 1 according to some embodiments includes the cylindrical casing wall 31, the cylindrical outer diffuser 33 disposed on the radially inner side of the casing wall 31, the inner diffuser 35 disposed on the radially inner side of the outer diffuser 33 and forming the diffuser passage 34 between the inner diffuser 35 and the outer diffuser 33, and the strut cover 5. The flare member 7 of the strut cover 5 includes the outer flare member 7A connected to the outer diffuser 33 and the inner flare member 7B connected to the inner diffuser 35.

According to the above configuration, the flare member 7 of the strut cover 5 includes the outer flare member 7A connected to the outer diffuser 33 and the inner flare member 7B connected to the inner diffuser 35. Since each of the outer flare member 7A and the inner flare member 7B has a thickness larger than the minimum thickness of the cylindrical sheet metal member 6 at least in the curved portion 71, the stress generated in the curved portion 71 can be reduced, so that it is possible to improve the high cycle fatigue strength of the strut cover 5.

In some embodiments, as shown in FIG. 2, in a cross-section along the axis EA of the exhaust casing 3, the thickness of the curved portion 71 upstream of at least the center axis CB in the diffuser passage 34 is larger in the outer flare member 7A than in the inner flare member 7B.

According to the above configuration, the diffuser passage 34 is hotter and the flow velocity of the combustion gas is higher on the outer peripheral side (the radially outer side) of the exhaust casing 3 where the outer flare member 7A is located than on the inner peripheral side (the radially inner side) where the inner flare member 7B is located. Thus, a larger force acts on the outer flare member 7A than on the inner flare member 7B. By making the thickness of the curved portion 71 upstream of the center axis CB in the diffuser passage 34 in the outer flare member 7A than in the inner flare member 7B, the stress generated in the curved portion 71 can be reduced, so that it is possible to improve the high cycle fatigue strength of the strut cover 5.

In some embodiments, at least one of the outer diffuser 33 or the inner diffuser 35 is a sheet metal part.

According to the above configuration, since at least one of the outer diffuser 33 or the inner diffuser 35 is a sheet metal part, the thickness of the diffuser can be reduced, so that the reduction in the flow-passage cross-sectional area of the diffuser passage 34 can be suppressed. Further, since at least one of the outer diffuser 33 or the inner diffuser 35 is a sheet metal part, it vibrates greatly due to the combustion gas flowing through the diffuser passage 34, and vibration stress is generated in the flare member 7 of the strut cover 5. By increasing the thickness of the curved portion 71 of the flare member 7, the vibration stress generated in the curved portion 71 can be reduced, so that it is possible to improve the high cycle fatigue strength of the strut cover 5.

The gas turbine 1 according to some embodiments includes the above-described exhaust casing 3, as shown in FIG. 1. According to the above configuration, the exhaust casing 3 of the gas turbine 1 includes the above-described strut cover 5. In this case, since the reduction in the flow-passage cross-sectional area of the diffuser passage 34 is suppressed, it is possible to suppress the reduction in performance of the gas turbine 1. Further, since the high cycle fatigue strength of the strut cover 5 is improved, it is possible to improve the reliability of the gas turbine 1 for long-term operation.

The present disclosure is not limited to the embodiments described above, but includes modifications to the embodiments described above, and embodiments composed of combinations of those embodiments.

The contents described in the above embodiments would be understood as follows, for instance.

1) A strut cover (5) for a gas turbine (1) according to at least one embodiment of the present disclosure comprises: a cylindrical sheet metal member (6) having a hollow portion (61); and a flare member (7) that is connected to one end of the cylindrical sheet metal member (6) in an axial direction of the cylindrical sheet metal member (6) and includes a curved portion (71) having an outer surface (711) such that a distance from a center axis (CB) of the cylindrical sheet metal member (6) to the outer surface (711) increases with increasing a distance from the cylindrical sheet metal member (6) in the axial direction. The flare member (7) has a thickness larger than a minimum thickness (TC) of the cylindrical sheet metal member (6) at least in the curved portion (71).

According to the above configuration 1), the strut cover includes the cylindrical sheet metal member having the hollow portion and the flare member. The flare member has a thickness larger than the minimum thickness of the cylindrical sheet metal member at least in the curved portion. In this case, since the curved portion of the flare member is thick, the stress generated in the curved portion can be reduced. By reducing the stress generated in the curved portion, it is possible to improve the high cycle fatigue strength of the strut cover.

Further, according to the above configuration 1), the wall thickness of the cylindrical sheet metal member can be reduced compared to a casting part formed by casting. By reducing the wall thickness of the cylindrical sheet metal member, the outer surface of the cylindrical sheet metal member can be brought closer to the center axis of the cylindrical sheet metal member, and thus the reduction in the flow-passage cross-sectional area of the diffuser passage (34) can be suppressed. By suppressing the reduction in the flow-passage cross-sectional area of the diffuser passage, it is possible to suppress the reduction in performance of the gas turbine.

2) In some embodiments, in the strut cover (5) described in 1), an inner surface (712) of the curved portion (71) of the flare member (7) protrudes toward the center axis (CB) with respect to an inner surface (65) of the cylindrical sheet metal member (6).

According to the above configuration 2), since the inner surface of the curved portion of the flare member protrudes toward the center axis with respect to the inner surface of the cylindrical sheet metal member, the thickness of the curved portion can be increased while suppressing the reduction in the flow-passage cross-sectional area of the diffuser passage (34) due to an increase in distance of the outer surface (711) of the curved portion from the center axis.

3) In some embodiments, in the strut cover (5) described in 1) or 2), the flare member (7) includes: a connection end (70) connected to the cylindrical sheet metal member (6); and a flange portion (73) disposed on an opposite side of the curved portion (71) from the connection end (70). In a cross-section along the center axis (CB), the flare member (7) bulges on an opposite side of a tangential line (TL) to an inner surface (732) of the flange portion (73) in an outer peripheral region (731) of the flange portion (73) from the cylindrical sheet metal member (6).

According to the above configuration 3), in a cross-section along the center axis, since the flare member bulges on the opposite side of the tangential line from the cylindrical sheet metal member, the thickness of the portion including the bulge portion (75) of the flare member can be increased while suppressing the reduction in the flow-passage cross-sectional area of the diffuser passage (34) due to an increase in distance of the outer surface of the curved portion (outer surface 711 of curved portion 71 or outer surface 733 of flange portion 73) from the tangential line.

4) In some embodiments, in the strut cover (5) described in 3), in a cross-section along the center axis (CB), an inner surface (751) of the bulge portion (75) of the flare member (7) that bulges on the opposite side of the tangential line (TL) from the cylindrical sheet metal member (6) curves convexly.

According to the above configuration 4), since the inner surface of the bulge portion of the flare member curves convexly, the bulge portion is prevented from becoming excessively thick. By preventing the bulge portion from becoming excessively thick, the thermal stress caused by the temperature difference between the inner surface facing the cooling passage (e.g., first cooling passage 38A) of the bulge portion and the outer surface (e.g., outer surface 711, 733) disposed on the opposite side from the inner surface in the thickness direction can be reduced. By reducing the thermal stress generated in the flare member, it is possible to improve the high cycle fatigue strength of the strut cover.

Further, according to the above configuration, since the inner surface of the bulge portion of the flare member curves convexly, the shape change of the inner surface is gradual, and the stress concentration in the flare member can be relaxed. By relaxing the stress concentration in the flare member, it is possible to improve the high cycle fatigue strength of the strut cover.

5) In some embodiments, in the strut cover (5) described in any one of 1) to 4), the flare member (7) includes: a connection end (70) connected to the cylindrical sheet metal member (6); and a flange portion (73) disposed on an opposite side of the curved portion (71) from the connection end (70). The flare member (7) includes: a first region (AR1, for example AR3 in FIG. 9 and AR5 in FIG. 10) where a tangential direction to an outer surface (733) of the flange portion (73) and the center axis (CB) makes a first angle ($\alpha$, for example $\alpha$1 and $\alpha$2); and a second region (AR2, for example AR4 in FIG. 9 and AR6 in FIG. 10), disposed so as to face the first region (AR1) with the center axis (CB) therebetween, where the tangential direction to the outer surface (733) of the flange portion (73) and the center axis (CB) makes a second angle ($\beta$, for example $\beta$1 and $\beta$2) that is larger than the first angle ($\alpha$). The curved portion (71) has a smaller thickness in the second region (AR2) than in the first region (AR1).

According to the above configuration 5), the angle between the tangential direction to the outer surface of the flange portion and the center axis is larger in the second region than in the first region. Therefore, the curved portion (71B) in the second region is gently curved as compared to the curved portion (71A) in the first region, and the stress generated in the curved portion (71B) is small in the second region, so that the thickness of the curved portion (71B) can be reduced. Thus, when the thickness of the curved portion fluctuates according to the angle (first angle $\alpha$ and second angle $\beta$) in the first region and the second region, the thickness of the curved portion in each of the first region and the second region can be made appropriate while suppressing the reduction in the flow-passage cross-sectional area of the diffuser passage (34). By making the thickness of the curved portion appropriate, the vibration stress and thermal stress generated in the curved portion can be reduced. Thus, it is possible to improve the high cycle fatigue strength of the strut cover.

6) In some embodiments, in the strut cover (5) described in 5), in a cross-section perpendicular to the center axis (CB), the hollow portion (61) has a minor axis (MA) and a major axis (LA) larger than the minor axis (MA). The first region (region AR3) and the second region (region AR4) of the flare member (7) face each other in a direction along the major axis (LA) of the hollow portion (61), with the center axis (CB) therebetween.

According to the above configuration 6), the first region of the flare member is disposed on one side in the direction along the major axis, and the second region is disposed on the other side in the direction along the major axis. That is, since the angle between the tangential direction to the outer surface (733) of the flange portion (73) and the center axis is larger in the region (second region) disposed on the other side in the direction along the major axis than in the region (first region) disposed on one side in the direction along the major axis, the stress generated in the curved portion (71B) in the region is small, and thus the thickness of the curved portion in the region can be reduced. Thus, according to the above configuration, the thickness of the curved portion (71)

can be made appropriate in each of the region (first region) disposed on one side in the direction along the major axis and the region (second region) disposed on the other side in the direction along the major axis.

7) In some embodiments, in the strut cover (5) described in 5), in a cross-section perpendicular to the center axis (CB), the hollow portion (61) has a minor axis (MA) and a major axis (LA) larger than the minor axis (MA). The first region (region AR5) and the second region (region AR6) of the flare member (7) face each other in a direction along the minor axis (MA) of the hollow portion (61), with the center axis (CB) therebetween.

According to the above configuration 7), the first region of the flare member is disposed on one side in the direction along the minor axis, and the second region is disposed on the other side in the direction along the minor axis. That is, since the angle between the tangential direction to the outer surface (733) of the flange portion (73) and the center axis is larger in the region (second region) disposed on the other side in the direction along the minor axis than in the region (first region) disposed on one side in the direction along the minor axis, the stress generated in the curved portion (71B) in the region is small, and thus the thickness of the curved portion in the region can be reduced. Thus, according to the above configuration, the thickness of the curved portion (71) can be made appropriate in each of the region (first region) disposed on one side in the direction along the minor axis and the region (second region) disposed on the other side in the direction along the minor axis.

8) In some embodiments, in the strut cover (5) described in any one of 1) to 4), the flare member (7) includes: a connection end (70) connected to the cylindrical sheet metal member (6); and a cylindrical portion (72) extending along the center axis (CB) between the curved portion (71) and the connection end (70). In a cross-section perpendicular to the center axis (CB), the hollow portion (61) has a minor axis (MA) and a major axis (LA) larger than the minor axis (MA). The flare member (7) includes: a third region (BR1) intersecting a straight line (LA1) extending from the center axis (CB) in a direction along the major axis (LA) in a cross-section perpendicular to the center axis (CB); and a fourth region (BR2) intersecting a straight line (MA1) extending from the center axis (CB) in a direction along the minor axis (MA) in a cross-section perpendicular to the center axis (CB). The cylindrical portion (72) has a thinner thickness in the fourth region (BR2) than in the third region (BR1).

According to the above configuration 8), the combustion gas flowing through the diffuser passage has not only a velocity component along the axial direction of the exhaust casing but also a velocity component that swirls along the circumferential direction. Therefore, when the combustion gas impinges on the strut cover, the impingement force acts to twist the strut cover. Thus, a larger force acts on the major axis end of the flare member, that is, the third region, than on the minor axis end of the flare member, that is, the fourth region. By making the thickness (TT1) of the cylindrical portion in the third region larger than the thickness (TT2) of the cylindrical portion in the fourth region, the stress generated in the third region can be reduced, so that it is possible to improve the high cycle fatigue strength of the strut cover.

9) In some embodiments, in the strut cover (5) described in any one of 1) to 8), the flare member (7) is a casting part formed by casting.

According to the above configuration 9), since the flare member is a casting part, the wall thickness can be easily increased compared to a sheet metal part formed by sheet metal processing. Further, the flare member which is a casting part allows the curvature radius of the outer surface of the curved portion to be reduced compared to a sheet metal part, the reduction in the flow-passage cross-sectional area of the diffuser passage (34) can be effectively suppressed.

10) An exhaust casing (3) of a gas turbine (1) according to at least one embodiment of the present disclosure comprises: a cylindrical casing wall (31); a cylindrical outer diffuser (33) disposed on a radially inner side of the casing wall (31); an inner diffuser (35) disposed on a radially inner side of the outer diffuser (33) and forming a diffuser passage (34) between the inner diffuser (35) and the outer diffuser (33); and the strut cover (5) described in any one of 1) to 9). The flare member (7) of the strut cover (5) includes: an outer flare member (7A) connected to the outer diffuser (33); and an inner flare member (7B) connected to the inner diffuser (35).

According to the above configuration 10), the flare member of the strut cover includes the outer flare member connected to the outer diffuser and the inner flare member connected to the inner diffuser. Since each of the outer flare member and the inner flare member has a thickness larger than the minimum thickness of the cylindrical sheet metal member at least in the curved portion, the stress generated in the curved portion can be reduced, so that it is possible to improve the high cycle fatigue strength of the strut cover.

11) In some embodiments, in the exhaust casing (3) described in 10), in a cross-section along an axis (EA) of the exhaust casing (3), a thickness of the curved portion (71) upstream of at least the center axis (CB) in the diffuser passage (34) is thicker in the outer flare member (7A) than in the inner flare member (7B).

According to the above configuration 11), the diffuser passage is hotter on the outer peripheral side of the exhaust casing where the outer flare member is located than on the inner peripheral side where the inner flare member is located, and a larger force acts on the outer flare member than on the inner flare member. By making the thickness of the curved portion upstream of the center axis in the diffuser passage in the outer flare member than in the inner flare member, the stress generated in the curved portion can be reduced, so that it is possible to improve the high cycle fatigue strength of the strut cover.

12) In some embodiments, in the exhaust casing (3) described in 10) or 11), at least one of the outer diffuser (33) or the inner diffuser (35) is a sheet metal part.

According to the above configuration 12), since at least one of the outer diffuser or the inner diffuser is a sheet metal part, the thickness of the diffuser can be reduced, so that the reduction in the flow-passage cross-sectional area of the diffuser passage can be suppressed. Further, since at least one of the outer diffuser or the inner diffuser is a sheet metal part, it vibrates greatly due to the combustion gas flowing through the diffuser passage, and vibration stress is generated in the flare member of the strut cover. By increasing the thickness of the curved portion of the flare member, the vibration stress generated in the curved portion can be reduced, so that it is possible to improve the high cycle fatigue strength of the strut cover.

13) A gas turbine (1) according to at least one embodiment of the present disclosure comprises the exhaust casing (3) described in any one of (10) to (12).

According to the above configuration 13), the exhaust casing of the gas turbine includes the above-described strut cover (5). In this case, since the reduction in the flow-passage cross-sectional area of the diffuser passage (34) is suppressed, it is possible to suppress the reduction in performance of the gas turbine. Further, since the high cycle fatigue strength of the strut cover is improved, it is possible to improve the reliability of the gas turbine for long-term operation.

REFERENCE SIGNS LIST

1 Gas turbine
3 Exhaust casing
31 Casing wall
32 Bearing casing
33 Outer diffuser
34 Diffuser passage
34A Diffuser inlet portion
35 Inner diffuser
36 Partition wall
37 Bearing portion
38A, 38B, 38C Cooling passage
4 Strut
41 Outer surface
5 Strut cover
6 Cylindrical sheet metal member
61 Hollow portion
62 One end
63 Upper end
64 Lower end
7 Flare member
7A Outer flare member
7B Inner flare member
70 Connection end
71 Curved portion
72 Cylindrical portion
73 Flange portion
74 Thick-walled portion
75 Bulge portion
76 Hollow portion
77 Inner peripheral rib
11 Compressor
12 Combustor
13 Turbine
14 Compressor casing
15, 23 Stator blade
16 Rotor
17, 24 Rotor blade
18 Air inlet
21 Turbine casing
22 Combustion gas passage
24A Final stage rotor blade
AR1 First region
AR2 Second region
AR3 to AR6 Region
BR1 Third region
BR2 Fourth region
CA Center axis of rotor
CB Center axis of cylindrical sheet metal member
EA Axis
LA Major axis
LA1, MA1 Straight line
MA Minor axis
R1, R2 Curvature radius
TC Minimum thickness
TF Thickness
TL Tangential line

The invention claimed is:

1. A strut cover for a gas turbine, comprising:

a cylindrical sheet metal member having a hollow portion; and a flare member that is connected to one end of the cylindrical sheet metal member in an axial direction of the cylindrical sheet metal member and includes a curved portion having an outer surface such that a distance from a center axis of the cylindrical sheet metal member to the outer surface increases with increasing a distance from the cylindrical sheet metal member in the axial direction, wherein the flare member has a thickness larger than a minimum thickness of the cylindrical sheet metal member at least in the curved portion, wherein an inner surface of the curved portion of the flare member protrudes toward the center axis with respect to an inner surface of the cylindrical sheet metal member, wherein the flare member includes:

a connection end connected to the cylindrical sheet metal member; and a flange portion disposed on an opposite side of the curved portion from the connection end, and wherein, in a cross-section along the center axis, the flare member bulges at a bulge portion on an opposite side of a tangential line from the cylindrical sheet metal member, the tangential line being tangential to an inner surface of the flange portion in an outer peripheral region of the flange portion, wherein, in the cross-section along the center axis, an inner surface of the bulge portion of the flare member that bulges on the opposite side of the tangential line from the cylindrical sheet metal member curves convexly, wherein, in the cross-section along the center axis, the curved portion of the flare member includes a thick-walled portion that protrudes toward the center axis of the cylindrical sheet metal member with respect to the inner surface of the cylindrical sheet metal member, and an inner surface of the thick-walled portion curves convexly, and wherein the inner surface of the bulge portion and the inner surface of the thick-walled portion are connected to form a convexly-curved curve.

2. The strut cover according to claim 1, wherein the flare member includes:

a connection end connected to the cylindrical sheet metal member; and a flange portion disposed on an opposite side of the curved portion from the connection end, and wherein the flare member includes:

a first region where a tangential direction to an outer surface of the flange portion and the center axis makes a first angle on a same side as the cylindrical sheet metal member; and a second region, disposed so as to face the first region with the center axis therebetween, where the tangential direction to the outer surface of the flange portion and the center axis makes a second angle on a same side as the cylindrical sheet metal member, and the second angle is larger than the first angle, wherein the curved portion has a smaller thickness in the second region than in the first region.

3. The strut cover according to claim 2, wherein, in a cross-section perpendicular to the center axis, the hollow portion has a minor axis and a major axis larger than the minor axis, and wherein the first region and the second region of the flare member face each other in a direction along the major axis of the hollow portion, with the center axis therebetween.

4. The strut cover according to claim 2, wherein, in a cross-section perpendicular to the center axis, the hollow portion has a minor axis and a major axis larger than the minor axis, and wherein the first region and the second region of the flare member face each other in a direction along the minor axis of the hollow portion, with the center axis therebetween.

5. The strut cover according to claim 1, wherein the flare member includes:

a connection end connected to the cylindrical sheet metal member; and a cylindrical portion extending along the center axis between the curved portion and the connection end, wherein, in a cross-section perpendicular to the center axis, the hollow portion has a minor axis and a major axis larger than the minor axis, and wherein the flare member includes:

a third region intersecting a straight line extending from the center axis in a direction along the major axis in a cross-section perpendicular to the center axis; and a fourth region intersecting a straight line extending from the center axis in a direction along the minor axis in a cross-section perpendicular to the center axis, wherein the cylindrical portion has a thinner thickness in the fourth region than in the third region.

6. The strut cover according to claim 1, wherein the flare member is a casting part formed by casting.

7. An exhaust casing of a gas turbine, comprising:

a cylindrical casing wall;

a cylindrical outer diffuser disposed on a radially inner side of the casing wall;

an inner diffuser disposed on a radially inner side of the outer diffuser and forming a diffuser passage between the inner diffuser and the outer diffuser; and the strut cover according to claim 1, wherein the flare member of the strut cover includes:

an outer flare member connected to the outer diffuser; and an inner flare member connected to the inner diffuser.

8. The exhaust casing according to claim 7, wherein, in a cross-section along an axis of the exhaust casing, a thickness of the curved portion upstream of at least the center axis in the diffuser passage is thicker in the outer flare member than in the inner flare member.

9. The exhaust casing according to claim 7, wherein at least one of the outer diffuser or the inner diffuser is a sheet metal part.

10. A gas turbine, comprising the exhaust casing according to claim 7.

* * * * *